US009644254B2

(12) United States Patent
Gao et al.

(10) Patent No.: US 9,644,254 B2
(45) Date of Patent: May 9, 2017

(54) METHOD FOR ADJUSTING PORE SIZE OF POROUS METAL MATERIAL AND PORE STRUCTURE OF POROUS METAL MATERIAL

(75) Inventors: Lin Gao, Chengdu (CN); Yuehui He, Chengdu (CN); Tao Wang, Chengdu (CN); Bo Li, Chengdu (CN)

(73) Assignee: Intermet Technologies Chengdu Co., Ltd., Chengdu, Sichuan (CN)

( * ) Notice: Subject to any disclaimer, the term of this patent is extended or adjusted under 35 U.S.C. 154(b) by 385 days.

(21) Appl. No.: 14/368,435

(22) PCT Filed: Dec. 31, 2011

(86) PCT No.: PCT/CN2011/085105

§ 371 (c)(1),
(2), (4) Date: Jun. 24, 2014

(87) PCT Pub. No.: WO2013/097205

PCT Pub. Date: Jul. 4, 2013

(65) Prior Publication Data

US 2014/0352848 A1 Dec. 4, 2014

(30) Foreign Application Priority Data

Dec. 28, 2011 (CN) ..... 2011 1 0448049

(51) Int. Cl.
*C23C 8/20* (2006.01)
*C23C 10/00* (2006.01)
(Continued)

(52) U.S. Cl.
CPC ..... *C23C 8/20* (2013.01); *B05D 7/14* (2013.01); *B05D 7/22* (2013.01); *C23C 8/08* (2013.01); *C23C 8/22* (2013.01); *C23C 8/24* (2013.01); *C23C 8/26* (2013.01); *C23C 8/30* (2013.01); *C23C 8/32* (2013.01); *C23C 10/00* (2013.01); *B05D 2202/10* (2013.01); *B05D 2202/35* (2013.01); *B05D 2202/40* (2013.01); *B05D 2259/00* (2013.01); *Y10T 428/249957* (2015.04)

(58) Field of Classification Search
CPC ..... C23C 8/20
See application file for complete search history.

(56) References Cited

U.S. PATENT DOCUMENTS 4,756,774 A * 7/1988 Fox ..... C21D 1/53 148/209

FOREIGN PATENT DOCUMENTS

JP 07-278782 * 10/1995

OTHER PUBLICATIONS

Jun, Chang-Soo, and Kew-Ho Lee. "Palladium and palladium alloy composite membranes prepared by metal-organic chemical vapor deposition method (cold-wall)." Journal of Membrane Science 176.1 (2000): 121-130.*

(Continued)

*Primary Examiner* — Jessee Roe
(74) *Attorney, Agent, or Firm* — Meng Ouyang

(57) ABSTRACT

Disclosed are a method for adjusting the pore size of a porous metal material and the pore structure of a porous metal material. The method comprises: permeating at least one element into the surface of the pores of the material to generate a permeated layer on the surface of the pores, so that the average pore size of the porous material is reduced to within a certain range, thus obtaining a pore structure of the porous metal material having the pores distributed on the surface of the material and the permeated layer provided on the surface of the pores.

3 Claims, 3 Drawing Sheets

(51) Int. Cl.

| | |
|---|---|
| ***B05D 7/14*** | (2006.01) |
| ***B05D 7/22*** | (2006.01) |
| ***C23C 8/22*** | (2006.01) |
| ***C23C 8/24*** | (2006.01) |
| ***C23C 8/26*** | (2006.01) |
| ***C23C 8/30*** | (2006.01) |
| ***C23C 8/32*** | (2006.01) |
| ***C23C 8/08*** | (2006.01) |

(56) References Cited

OTHER PUBLICATIONS

Chel'tsov, V. Ya, E. I. Zhluktenko, and R. G. Rakitskaya. "The boronizing of parts from iron-base powders in borate slags." Powder Metallurgy and Metal Ceramics 16.1 (1977): 44-46.*

English Abstract and English Machine Translation of JP 07-278782 (Oct. 24, 1995).*

Authors: Qiang Xu, Xin-Yan Tang, Yang Pu Title: the Surface Carburizing Treatment Methods of TiAl Based Alloys Title of Item: Thermal Treatment Technology and Equipment (journal) pp. 54-56, vol. 29, No. 5, Oct. 2008 Publisher: China Academic Journal Electronic Publishing House.

Authors: Yao Jiang, Yuehui He, Yiwu Tang, Zhi Li, Boyun Huang Title: Behavior and Mechanism of TiAl Based Alloy Surface Carburization Title of Item: Chinese Journal of Materials Research pp. 139-146, vol. 19, No. 2, Apr. 2005 Publisher: China Academic Journal Electronic Publishing House.

* cited by examiner

TiAl, NiAl carburizing for 6 hours

TiAl carburizing at 900°C

FeAl carburizing at 940°C

METHOD FOR ADJUSTING PORE SIZE OF POROUS METAL MATERIAL AND PORE STRUCTURE OF POROUS METAL MATERIAL

TECHNICAL FIELD OF THE INVENTION

This invention relates to chemical-thermal treatment techniques of porous metal materials. For the first time, it proposes adjusting pore diameters of porous metal materials by chemical-thermal treatments, so as to not only ensure filtration precision, but also improve the surface properties of the porous metal materials. Furthermore, this invention relates to the pore structures of the porous metal materials after the chemical-thermal treatments.

BACKGROUND OF THE INVENTION

Chemical-thermal treatment is a thermal treatment process in which a metallic workpiece is placed in an active medium with a certain temperature, and one or more elements permeate into its surface. Thus, its chemical composition, microstructure and properties are changed. There are many kinds of chemical-thermal treatment methods, and the most common methods are carburizing, nitriding and carbonitriding. The purpose for chemical-thermal treatments in general is to improve the surface wear resistance, fatigue strength, corrosion resistance and high temperature oxidation resistance. The article "Behavior and Mechanism of TiAl Based Alloy Surface Carburization" by Yao Jiang, Yuehui He, et. al., published in Vol. 19, No. 2, Chinese Journal of Materials Research, April 2005, proposed that the high temperature oxidation resistance of TiAl based alloy can be improved through carburizing. Another article, "The Surface Carburizing Treatment Methods of TiAl Based Alloys" by Qiang Xu, Xin-yan Tang and Yang Pu present a similar view. Currently, chemical-thermal treatment processes are mainly used to improve surface properties of relatively dense metallic materials, whereas its application on porous metal materials has not been reported yet.

On the other hand, due to the permeability of porous metal materials, a variety of filter elements made of porous metal materials have been developed. Common porous metal materials are stainless steels, copper and copper alloys, nickel and nickel alloys, titanium and titanium alloys. These kinds of porous metal materials have relatively good machinability but relatively poor corrosion resistance. Another kind of porous metal materials are aluminum-based intermetallic compound porous materials, mainly including TiAl intermetallic compound porous materials, NiAl intermetallic compound porous materials and FeAl intermetallic compound porous materials. These porous metal materials have both excellent machinability and good corrosion resistance. Both the common porous metal materials and the Al-based intermetallic compound porous materials are manufactured by powder metallurgy methods, and in the manufacturing process many factors can affect the final pore diameters of the porous metal materials, such as the average particle size, particle size distribution, particle shape and sintering temperature.

In summary, for now people in this field usually adjust the pore diameters only from the perspective of powder metallurgy processes to fit different filtering requirements. Since adjusting the powder metallurgy processes would easily change the mechanical properties of the materials, feasible solutions can be ascertained usually through a lot of trials, and the range of adjustable pore diameters is limited.

SUMMARY OF THE INVENTION

This invention intends to provide a method for adjusting pore diameters of porous metal materials through chemical-thermal treatments.

For this purpose, the method for adjusting pore diameters of porous metal materials is permeating at least one element into the pores of the materials, and the average pore diameter is reduced within a certain range. When an element permeates into the pore surfaces of the porous metal materials, lattice distortion inflation or new phase layers form on the inner surfaces of the pores, so the original pores of the porous metal materials shrink and the purpose of adjusting pore diameters is realized. Therefore, this method for adjusting pore diameters referred in the invention is more convenient and controllable than the current methods for adjusting pore diameters; further, because the method only treats the surfaces of the materials, the mechanical properties of the materials will not be significantly affected.

Considering the general needs of filtration, the preferred method in the current invention is that by permeating at least one element into the pore surfaces of the materials, the average pore diameter is reduced to 0.05~100 μm.

The amount of reduction of the average pore diameter is related to the particular chemical-thermal treatment process. If the amount of reduction of the average pore diameter of the materials is very small, the practical effect of the current invention in the aspect of adjusting pore diameters is reduced. Whereas if the amount of reduction of the average pores diameter of the materials is very large, the original pores of the porous metal material might be closed, resulting in significant reduction of the filtration flux. Thus, the preferred solution of the current invention is that by permeating at least one element into the pore surfaces of the materials, the average pore diameter is reduced by 0.1~100 μm.

Furthermore, the porous metal materials are the Al-based porous intermetallic compound materials. Preferably, the Al-based porous intermetallic compound materials are one type of TiAl porous intermetallic compound materials, NiAl porous intermetallic compound materials or FeAl porous intermetallic compound materials.

Preferably, the permeating element is at least one of carbon, nitrogen, boron, sulfur, silicon, aluminum and chromium.

The specific process of the current invention for carburizing TiAl intermetallic compound porous material is: first the TiAl intermetallic compound porous material was placed in an active carburizing atmosphere and maintained at 800~1200° C. for 1~12 h in the furnace with controlled carbon potential of 0.8%~1.0%, and the and the final thickness of the carburized layers obtained are thickness 1~30 μm.

The specific process of the current invention for carburizing NiAl intermetallic compound porous material is: first the NiAl intermetallic compound porous material was placed in an active carburizing atmosphere and maintained at 800~1200° C. for 2~10 h in the furnace with carbon potential of 1.0%~1.2%, and the final thickness of the carburized layers obtained are thickness 0.5~25 μm.

The specific process of the current invention for carburizing FeAl intermetallic compound porous material is: first the FeAl intermetallic compound porous material was placed in an active carburizing atmosphere and maintained at 800~1200° C. for 1~9 h in the furnace with controlled carbon potential of 0.8%~1.2%, and the final thickness of the carburized layers obtained are thickness 1~50 μm, The above-described carburizing processes for porous TiAl intermetallic compound porous materials, NiAl intermetallic compound porous materials and FeAl intermetallic compound porous materials can result in carburized layers of the thickness of $10^{-1}$ μm~10 μm, so that precise control of the thickness of the carburized layers can be achieved. Also, maintaining the thickness of carburized layers within this range can significantly improve the high temperature oxidation resistance and corrosion resistance of the materials.

The specific process of the current invention for nitriding TiAl intermetallic compound porous material is: first the TiAl intermetallic compound porous material was placed in an active nitriding atmosphere and maintained at 800~1000° C. for 4~20 h, while the nitrogen potential in the furnace, with controlled nitrogen potential of 0.8%~1.0%, and the final nitrided layers obtained thickness are 0.5~20 μm.

The specific process of the current invention for nitriding NiAl intermetallic compound porous material is: first the NiAl intermetallic compound porous material was placed in an active nitriding atmosphere and maintained at 700~900° C. for 2~26 h in the furnace with controlled carbon potential of 1.0%~1.2%, and the final nitrided layers obtained are thickness 0.5~15 μm.

The specific process of the current invention for nitriding FeAl intermetallic compound porous material is: first the FeAl intermetallic compound porous material was placed in an active nitriding atmosphere and maintained at 550~750° C. for 2~18 h in the furnace with controlled carbon potential of 0.8%~1.2%, and the final nitrided layers obtained are thickness 1~25 μm.

The above-described nitriding processes for porous TiAl intermetallic compound porous materials, NiAl intermetallic compound porous materials and FeAl intermetallic compound porous materials can result in nitrided layers of the thickness of $10^{-1}$ μm~10 μm, so that precise control of the thickness of the nitride layers are achieved. Also, maintaining the thickness of the nitride layers to be within this range can significantly improve the corrosion resistance of the materials.

The specific process of the current invention for carbonitriding TiAl intermetallic compound porous material is: first the TiAl intermetallic compound porous material was placed in an active carbonitriding atmosphere and maintained at 800~1000° C. for 1~16 h in the furnace with controlled carbon potential of 0.8%~1.0%, and the final carbonitrided layers obtained are thickness 0.5~25 μm.

The specific process of the current invention for carbonitriding NiAl intermetallic compound porous material is: first the NiAl intermetallic compound porous material was placed in an active carbonitriding atmosphere and maintained at 750~950° C. for 2~18 h in the furnace with controlled carbon potential and nitrogen potential of 1.0%~1.2%, and the final carbonitrided layers obtained are thickness 0.5~20 μm.

The specific process of the current invention for carbonitriding FeAl intermetallic compound porous material is: first the FeAl intermetallic compound porous material was placed in an active carbonitriding atmosphere and maintained at 700~900° C. for 2~10 h in the furnace with controlled carbon potential and nitrogen potential of 0.8%~1.2% and the final carbonitrided layers obtained are thickness 1~35 μm.

The above-described carbonitriding process of porous TiAl, NiAl, and FeAl intermetallic compound porous materials can result in thickness of the carbonitrided layers of $10^{-1}$ μm~10 μm, such that price control of the thickness of the carbonitrided layers is achieved. Also, maintaining the thickness of the carbonitrided layers to be within this range can significantly improve the corrosion resistance and the high-temperature oxidation resistance of the materials.

Furthermore, in this invention, by localized anti-permeation treatments on the porous metal materials, thickness of the permeated layers finally formed in an asymmetrical manner between the front and the back. Here, "front and back" means the front and the back of the pores in which the permeated layers are disposed. The term "asymmetrical" mean that the thickness of the permeated layers decrease gradually from the front to the back along the directions of the pores. Thus, the morphology of the porous metal materials after the chemical-thermal treatments is formed to be similar to that of an "asymmetric membrane," wherein the pores on one side of the surface of the porous metal materials have relatively smaller pore diameters due to the larger thickness of the permeated layers, whereas the pores on the other side of the surface have relatively larger pore diameters due to thinner permeated layers. When the porous materials are used for filtration, the side with relatively smaller pore diameters can be used to achieve separation of the medium to be filtered, so that the permeability of the porous metal materials can be improved, as well as the backwash effect can be improved.

Above are the methods for adjusting pore diameters of porous metal materials provided by the current invention. Besides, the current invention additionally provides a type of pore structures of porous metal materials, wherein the pore structures have the required pore diameters.

For this, the pore structures of the porous metal materials in the current invention include pores distributed on the surfaces of the materials, with permeated layers covered on the surfaces of the pores. Because permeated layers are covered on the surfaces of the pores of the porous metal materials, and lattice distortion inflation occurs on the surface layers of the pores of the porous metal materials, or new phase layers form on the inner surface layers of the pores, thus the original pores of the porous metal materials are shrunk so that the purpose of adjusting pore diameters is achieved.

Considering the general needs of filtering, the average pore diameter of the pores is 0.05~100 μm.

Further, the porous metal materials refer to Al-based intermetallic compound porous materials. Preferably, the Al-based intermetallic compound porous materials are one type of TiAl intermetallic compound porous materials, NiAl intermetallic compound porous materials or FeAl intermetallic compound porous materials.

Preferably, the permeated layer is one type of carburized layers, nitrided layers, boride layers, sulfide layers, siliconized layers, aluminized layers or a chromized layers or co-permeated layers of at least two of the elements stated above, for example, a carbonitrided layer.

The first type of pore structures of porous metals material specifically provided by this invention is: the porous metal material is TiAl intermetallic compound porous material with carburized layers of the thickness of 1~30 μm covered on the pore surfaces.

The second type of pore structures of porous metal materials specifically provided by this invention is: the porous metal material is NiAl intermetallic compound porous material with carburized layers of the thickness of 0.5~25 μm covered on the pore surfaces.

The third type of pore structures of porous metal materials specifically provided by this invention is: the porous metal material is FeAl intermetallic compound porous material with carburized layers of the thickness of 1~50 μm covered on the pore surfaces.

The fourth type of pore structures of porous metal materials specifically provided by this invention is: the porous metal material is TiAl intermetallic compound porous material with nitrided layers of the thickness of 0.5~20 μm covered on the pore surfaces.

The fifth type of pore structures of porous metal materials specifically provided by this invention is: the porous metal material is NiAl intermetallic compound porous material with nitrided layers of the thickness of 0.5~15 μm covered on the pore surfaces.

The sixth type of pore structures of porous metal materials specifically provided by this invention is: the porous metal material is FeAl intermetallic compound porous material with nitrided layers of the thickness of 1~25 μm covered on the surfaces of the pores.

The seventh type of pore structures of porous metal materials specifically provided in this invention is: the porous metal material is FeAl intermetallic compound porous material with carbonitrided layers of the thickness of 0.5~25 μm covered on the surfaces of the pores.

The eighth type of pore structures of porous metal materials specifically provided in this invention is: the porous metal material is NiAl intermetallic compound porous material with carbonitrided layers of the thickness of 0.5~20 μm covered on the surfaces of the pores.

The ninth type of pore structures of porous metal materials specifically provided in this invention is: the porous metal material is FeAl intermetallic compound porous material with carbonitrided layers of the thickness of 1~35 μm covered on the surfaces of the pores.

Furthermore, the thickness of the permeated layers gradually decreases from front to back along the directions of the pores. Thus, the morphology of the porous metal materials of the current invention is formed similarly to that of an "asymmetric membrane," wherein the pores on one side of the surface of the porous metal material are of relatively smaller pore diameters due to the thicker permeated layers, whereas the pores on the other side of the surface are of relatively larger pore diameters due to the thinner permeated layers. When the porous metal materials are used for filtration, the side with relatively smaller pore diameters can be used to realize the separation of the medium to be filtered, so that the permeability of the porous metal materials can be improved, as well as the backwash effect can be improved.

Below, further illustrations are given through the Figures and the embodiments. Additional aspects and advantages of the present application will be partially given in the following part of the description, while some will become obvious from the following descriptions, or through practice of the current application.

Figure 1:
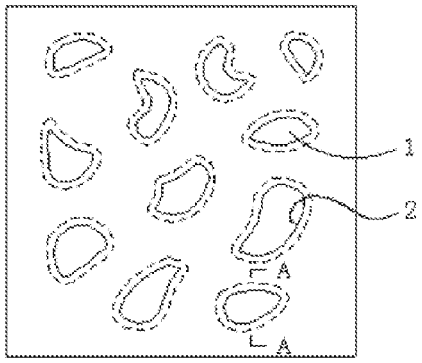
FIG. 1 is a schematic plan view of the pore structure of the porous metal materials of the invention.

In the FIGS., "1" is the pore, and "2" is the permeated layer.

EMBODIMENTS

Below, the methods of the current invention for adjusting pore diameters are explained further through the multiple groups of embodiments.

Embodiment 1

The first group of embodiments treated titanium porous materials with carburizing, nitriding and carbonitriding processes separately. Before the carburizing, nitriding and carbonitriding porcesses, the initial average pore diameter of the materials was 20 μm, and the initial porosity of the materials was 30%. The specific processing parameters, the average pore diameters after the chemical-thermal treatments and the porosities after the chemical-thermal treatments of this group of embodiments are shown in Table 1.

TABLE 1

| Chemical-thermal treatment | Temperature (° C.) | Time (h) | Carbon potential and/or nitrogen potential (%) | Pore structure of the material after the chemical-thermal treatment: Average pore diameter | Porosity (%) |
|---|---|---|---|---|---|
| Carburization | 850 | 1 | 1.0 | 19.2 | 27.6 |
| | | 3 | | 18.9 | 26.8 |
| | | 5 | | 18.4 | 25.4 |
| | | 7 | | 17.8 | 23.8 |
| | 950 | 1 | 1.0 | 16.4 | 20.1 |
| | | 3 | | 14.0 | 14.7 |
| | | 5 | | 13.2 | 13.1 |
| | | 7 | | 11.0 | 9.0 |
| Nitridation | 850 | 4 | 1.0 | 19.3 | 27.9 |
| | | 8 | | 18.7 | 27.6 |
| | | 12 | | 18.0 | 24.3 |
| | | 16 | | 17.5 | 22.9 |
| | 950 | 4 | 1.0 | 16.0 | 19.2 |
| | | 8 | | 13.6 | 13.9 |
| | | 12 | | 12.6 | 11.9 |
| | | 16 | | 10.6 | 8.4 |
| carbonitriding | 850 | 2 | 1.0 | 19.6 | 28.8 |
| | | 4 | | 19.0 | 26.9 |
| | | 6 | | 18.3 | 25.1 |
| | | 8 | | 18.0 | 24.3 |
| | 950 | 2 | 1.0 | 17.1 | 22.2 |
| | | 4 | | 16.2 | 19.7 |
| | | 6 | | 15.4 | 17.8 |
| | | 8 | | 13.8 | 13.9 |

Embodiment 2

The second group of embodiments treated TiAl intermetallic compound porous materials with carburizing processes. Before the carburizing processes, the initial average pore diameter of the materials was 15 μm, and the initial porosity of the materials was 45%. The specific processing parameters, the average pore diameters after the chemical-thermal treatment and the porosities after the chemical-thermal treatments of this group of embodiments are shown in Table 2.

TABLE 2

| Chemical-thermal treatment | Temperature (° C.) | Time (h) | Carbon potential (%) | Pore structure of the material after chemical-thermal treatment: Average pore diameter (μm) | Porosity (%) | Permeated layer thickness (μm) |
|---|---|---|---|---|---|---|
| Carburization | 800 | 1 | 1.0 | 14.6 | 42.6 | 1 |
| | | 3 | | 13.7 | 37.5 | — |
| | | 6 | | 13.2 | 34.8 | — |
| | | 9 | | 12.8 | 32.8 | — |
| | | 12 | | 12.3 | 30.2 | — |
| | 900 | 1 | 1.0 | 14.5 | 42.0 | — |
| | | 3 | | 13.4 | 35.9 | — |
| | | 6 | | 12.9 | 33.3 | — |
| | | 9 | | 12.3 | 30.3 | — |
| | | 12 | | 11.6 | 26.9 | — |
| | 1000 | 1 | 1.0 | 14.2 | 40.3 | — |
| | | 3 | | 13.1 | 34.4 | — |
| | | 6 | | 12.7 | 32.2 | — |
| | | 9 | | 11.6 | 26.9 | — |
| | | 12 | | 11.1 | 24.6 | — |
| | 1100 | 1 | 1.0 | 13.5 | 36.4 | — |
| | | 3 | | 12.7 | 32.2 | — |
| | | 6 | | 12.0 | 28.8 | — |
| | | 9 | | 11.1 | 24.6 | — |
| | | 12 | | 10.2 | 20.8 | — |
| | 1200 | 1 | 1.0 | 12.8 | 32.8 | — |
| | | 3 | | 12.1 | 29.3 | — |
| | | 6 | | 11.2 | 25.1 | — |
| | | 9 | | 10.2 | 20.8 | — |
| | | 12 | | 9.3 | 17.3 | 30 |

Embodiment 3

The third group of embodiments treated TiAl intermetallic compound porous materials with nitriding processes. Before the nitriding processes, the initial average pore diameter of the materials was 15 μm, and the initial porosity of the materials was 45%. The specific processing parameters, the average pore diameters after the chemical-thermal treatments and the porosities after the chemical-thermal treatments of this group of embodiments are shown in Table 3.

TABLE 3

| Chemical-thermal treatment | Temperature (° C.) | Time (h) | Nitrogen Potential (%) | Pore structure of the material after chemical-thermal treatment: Average pore diameter (μm) | Porosity (%) | Permeated layer thickness (μm) |
|---|---|---|---|---|---|---|
| Nitridation | 800 | 4 | 1.0 | 14.5 | 42.0 | 0.5 |
| | | 8 | | 13.8 | 38.0 | — |
| | | 12 | | 13.0 | 33.8 | — |
| | | 16 | | 12.7 | 32.3 | — |
| | | 20 | | 12.2 | 29.8 | — |
| | 850 | 4 | 1.0 | 14.3 | 40.9 | — |
| | | 8 | | 13.5 | 36.4 | — |
| | | 12 | | 12.7 | 32.2 | — |
| | | 16 | | 12.2 | 29.8 | — |
| | | 20 | | 11.8 | 27.8 | — |
| | 900 | 4 | 1.0 | 14.0 | 39.2 | — |
| | | 8 | | 13.1 | 34.3 | — |
| | | 12 | | 12.3 | 30.2 | — |
| | | 16 | | 11.4 | 26.0 | — |
| | | 20 | | 11.2 | 25.1 | — |
| | 950 | 4 | 1.0 | 13.4 | 35.9 | — |
| | | 8 | | 12.6 | 31.7 | — |
| | | 12 | | 11.6 | 26.9 | — |
| | | 16 | | 10.4 | 21.6 | — |
| | | 20 | | 10.3 | 21.2 | — |
| | 1000 | 4 | 1.0 | 12.9 | 33.0 | — |
| | | 8 | | 12.2 | 29.8 | — |
| | | 12 | | 11.1 | 24.6 | — |
| | | 16 | | 9.9 | 19.6 | — |
| | | 20 | | 9.0 | 16.2 | 20 |

Embodiment 4

The fourth group of embodiments treated TiAl intermetallic compound porous materials with carbonitriding processes. Before the carbonitriding processes, the initial average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 4.

TABLE 4

| Chemical-thermal treatment | Temperature (° C.) | Time (h) | Carbon potential and nitrogen potential (%) | Pore structure of the material after the chemical-thermal: Average pore diameter (μm) | Porosity (%) | Permeated layer thickness (μm) |
|---|---|---|---|---|---|---|
| Carbonitriding | 800 | 1 | 1.0 | 14.8 | 43.8 | 0.5 |
| | | 4 | | 14.1 | 39.8 | — |
| | | 8 | | 13.1 | 34.3 | — |
| | | 12 | | 12.6 | 31.8 | — |
| | | 16 | | 12.0 | 28.8 | — |
| | 850 | 1 | 1.0 | 14.7 | 43.2 | — |
| | | 4 | | 13.6 | 36.9 | — |
| | | 8 | | 12.8 | 32.7 | — |
| | | 12 | | 12.1 | 29.3 | — |
| | | 16 | | 11.5 | 26.4 | — |
| | 900 | 1 | 1.0 | 14.3 | 40.9 | — |
| | | 4 | | 13.2 | 34.8 | — |
| | | 8 | | 12.2 | 29.8 | — |
| | | 12 | | 11.3 | 25.5 | — |
| | | 16 | | 11.0 | 24.2 | — |
| | 950 | 1 | 1.0 | 13.6 | 36.9 | — |
| | | 4 | | 12.5 | 31.2 | — |
| | | 8 | | 11.4 | 26.0 | — |
| | | 12 | | 10.5 | 22.0 | — |
| | | 16 | | 10.0 | 20.0 | — |
| | 1000 | 1 | 1.0 | 13.1 | 34.3 | — |
| | | 4 | | 12.0 | 28.8 | — |
| | | 8 | | 10.4 | 21.6 | — |
| | | 12 | | 9.7 | 18.8 | — |
| | | 16 | | 9.0 | 16.2 | 25 |

Embodiment 5

The fifth group of embodiments treated porous TiAl materials with boronization processes. Before the boronization processes, the initial average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 5.

TABLE 5

| Chemical-thermal treatment | Temperature (° C.) | Time (h) | Boron potential (%) | Pore structure of the material after the chemical-thermal treatment: Average pore diameter (μm) | Porosity (%) |
|---|---|---|---|---|---|
| Boronization | 800 | 5 | 1.0 | 14.4 | 41.5 |
| | | 10 | | 13.6 | 36.9 |
| | | 15 | | 12.9 | 33.3 |
| | | 20 | | 12.4 | 30.7 |
| | | 25 | | 11.8 | 27.8 |

TABLE 5-continued

| Chemical-thermal treatment | Temperature (° C.) | Time (h) | Boron potential (%) | Pore structure of the material after the chemical-thermal treatment: Average pore diameter (μm) | Porosity (%) |
|---|---|---|---|---|---|
| | 850 | 5 | 1.0 | 14.2 | 40.3 |
| | | 10 | | 13.3 | 35.4 |

TABLE 5-continued

| Chemical-thermal treatment | Temperature (° C.) | Time (h) | Boron potential (%) | Pore structure of the material after the chemical-thermal treatment: Average pore diameter (μm) | Porosity (%) |
|---|---|---|---|---|---|
| | | 15 | | 12.6 | 31.7 |
| | | 20 | | 11.9 | 28.3 |
| | | 25 | | 11.4 | 25.9 |
| | 900 | 5 | 1.0 | 13.9 | 38.6 |
| | | 10 | | 12.9 | 33.3 |
| | | 15 | | 12.1 | 29.3 |
| | | 20 | | 11.2 | 25.1 |
| | | 25 | | 10.7 | 22.9 |
| | 950 | 5 | 1.0 | 13.2 | 34.8 |
| | | 10 | | 12.4 | 30.7 |
| | | 15 | | 11.3 | 25.5 |
| | | 20 | | 10.3 | 21.2 |
| | | 25 | | 9.8 | 19.2 |

TABLE 5-continued

| Chemical-thermal treatment | Temperature (° C.) | Time (h) | Boron potential (%) | Pore structure of the material after the chemical-thermal treatment: Average pore diameter (μm) | Porosity (%) |
|---|---|---|---|---|---|
| | 1000 | 5 | 1.0 | 12.7 | 32.3 |
| | | 10 | | 12.0 | 28.8 |
| | | 15 | | 10.5 | 22.0 |
| | | 20 | | 9.4 | 17.6 |
| | | 25 | | 8.8 | 15.5 |

Embodiment 6

The sixth group of embodiments treated NiAl intermetallic compound porous materials with carburizing processes. Before the carburizing processes, the average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 6.

TABLE 6

| Chemical-thermal treatment | Temperature (° C.) | Time (h) | Carbon potential (%) | Pore structure of the materials after chemical-thermal treatment: Average pore diameter (μm) | Porosity (%) | Permeated layer thickness (μm) |
|---|---|---|---|---|---|---|
| Carburization | 800 | 2 | 1.0 | 14.2 | 40.3 | 0.5 |
| | | 4 | | 13.6 | 36.9 | — |
| | | 6 | | 13.3 | 35.4 | — |
| | | 8 | | 13.1 | 34.3 | — |
| | | 10 | | 12.9 | 33.3 | — |
| | 900 | 2 | 1.0 | 14.0 | 39.2 | — |
| | | 4 | | 13.2 | 34.8 | — |
| | | 6 | | 12.8 | 32.8 | — |
| | | 8 | | 12.6 | 31.8 | — |
| | | 10 | | 12.5 | 31.3 | — |
| | 1000 | 2 | 1.0 | 13.8 | 38.1 | — |
| | | 4 | | 13.0 | 33. | — |
| | | 6 | | 12.3 | 30.3 | — |
| | | 8 | | 11.8 | 27.8 | — |
| | | 10 | | 11.5 | 28.3 | — |
| | 1100 | 2 | 1.0 | 13.4 | 35.9 | — |
| | | 4 | | 12.5 | 31.2 | — |
| | | 6 | | 11.8 | 27.8 | — |
| | | 8 | | 11.5 | 26.4 | — |
| | | 10 | | 10.9 | 23.8 | — |
| | 1200 | 2 | 1.0 | 13.0 | 33.8 | — |
| | | 4 | | 12.2 | 29.8 | — |
| | | 6 | | 11.3 | 25.5 | — |
| | | 8 | | 10.5 | 22.1 | — |
| | | 10 | | 10.1 | 20.4 | 25 |

Embodiment 7

The seventh group of embodiments treated NiAl intermetallic compound porous materials with nitriding processes. Before the nitriding processes, the average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 7.

TABLE 7

| Chemical-thermal treatment | Temperature (° C.) | Time (h) | Nitrogen potential (%) | Pore structure of the material after chemical-thermal treatment: Average pore diameter (μm) | Porosity (%) | Permeated layer thickness (μm) |
|---|---|---|---|---|---|---|
| Nitridation | 700 | 2 | 1.0 | 14.8 | 43.8 | 0.5 |
| | | 8 | | 14.7 | 43.2 | — |
| | | 14 | | 14.7 | 43.2 | — |
| | | 20 | | 14.6 | 42.6 | — |
| | | 26 | | 14.5 | 42.0 | — |

TABLE 7-continued

| Chemical-thermal treatment | Temperature (° C.) | Time (h) | Nitrogen potential (%) | Pore structure of the material after chemical-thermal treatment: Average pore diameter (μm) | Porosity (%) | Permeated layer thickness (μm) |
|---|---|---|---|---|---|---|
| | 750 | 2 | 1.0 | 14.6 | 42.6 | — |
| | | 8 | | 14.3 | 40.9 | — |
| | | 14 | | 14.0 | 39.2 | — |
| | | 20 | | 13.8 | 38.1 | — |
| | | 26 | | 13.7 | 37.5 | — |
| | 800 | 2 | 1.0 | 14.2 | 40.3 | — |
| | | 8 | | 13.4 | 35.9 | — |
| | | 14 | | 12.6 | 31.7 | — |
| | | 20 | | 12.1 | 29.3 | — |
| | | 26 | | 11.6 | 26.9 | — |
| | 850 | 2 | 1.0 | 13.7 | 37.5 | — |
| | | 8 | | 12.7 | 32.3 | — |
| | | 14 | | 12.0 | 28.8 | — |
| | | 20 | | 11.6 | 26.9 | — |
| | | 26 | | 11.1 | 24.6 | — |
| | 900 | 2 | 1.0 | 13.2 | 34.8 | — |
| | | 8 | | 12.4 | 30.3 | — |
| | | 14 | | 11.5 | 26.4 | — |
| | | 20 | | 10.6 | 22.5 | — |
| | | 26 | | 10.3 | 21.2 | 15 |

Embodiment 8

The eighth group of embodiments treated porous NiAl intermetallic compound porous materials with carbonitriding processes. Before the carbonitriding processes, the average pore size of the materials was 15 μm and the initial porosity of the materials was 45%. The specific processing parameters, the average pore diameters after the chemical-thermal treatments and the porosities after the chemical-thermal treatments of this group of embodiments are shown in Table 8.

Embodiment 9

The ninth group of embodiments treated porous NiAl intermetallic compound porous materials with boronization processes. Before the boronization processes, the initial average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 9.

TABLE 8

| Chemical-thermal treatment | Temperature (° C.) | Time (h) | Carbon potential and nitrogen potential (%) | Pore structure of the materials after chemical-thermal treatment: Average pore diameter (μm) | Porosity (%) | Permeated layer thickness (μm) |
|---|---|---|---|---|---|---|
| Carbonitriding | 750 | 2 | 1.0 | 14.6 | 42.6 | 0.5 |
| | | 6 | | 14.3 | 40.9 | — |
| | | 10 | | 14.1 | 39.8 | — |
| | | 14 | | 14.0 | 39.2 | — |
| | | 18 | | 13.9 | 38.6 | — |
| | 800 | 2 | 1.0 | 14.3 | 40.9 | — |
| | | 6 | | 13.9 | 38.6 | — |
| | | 10 | | 13.5 | 36.4 | — |
| | | 14 | | 13.2 | 34.8 | — |
| | | 18 | | 13.0 | 33.8 | — |
| | 850 | 2 | 1.0 | 14.0 | 39.2 | — |
| | | 6 | | 13.3 | 35.4 | — |
| | | 10 | | 12.4 | 30.7 | — |
| | | 14 | | 11.9 | 28.3 | — |
| | | 18 | | 11.4 | 25.9 | — |
| | 900 | 2 | 1.0 | 13.6 | 36.9 | — |
| | | 6 | | 12.6 | 31.7 | — |
| | | 10 | | 11.7 | 27.4 | — |
| | | 14 | | 11.4 | 25.9 | — |
| | | 18 | | 10.9 | 23.8 | — |
| | 950 | 2 | 1.0 | 13.1 | 34.3 | — |
| | | 6 | | 12.1 | 29.3 | — |
| | | 10 | | 11.2 | 25.1 | — |
| | | 14 | | 10.4 | 21.6 | — |
| | | 18 | | 10.2 | 20.8 | 20 |

TABLE 9

| Chemical-thermal treatment | Temperature (° C.) | Time (h) | Boron potential (%) | Pore structure of the material after the chemical-thermal treatments: Average pore size (μm) | Porosity (%) |
|---|---|---|---|---|---|
| Boronization | 650 | 2 | 1.0 | 14.9 | 44.4 |
| | | 6 | | 14.8 | 43.8 |
| | | 10 | | 14.7 | 43.2 |
| | | 14 | | 14.6 | 42.6 |
| | | 18 | | 14.5 | 42.0 |
| | 750 | 2 | 1.0 | 14.6 | 42.6 |
| | | 6 | | 14.3 | 40.9 |
| | | 10 | | 13.9 | 38.6 |
| | | 14 | | 13.7 | 37.5 |
| | | 18 | | 13.6 | 37.0 |
| | 850 | 2 | 1.0 | 14.1 | 39.8 |
| | | 6 | | 13.5 | 36.4 |
| | | 10 | | 12.7 | 32.3 |
| | | 14 | | 12.3 | 30.3 |
| | | 18 | | 11.8 | 27.8 |
| | 950 | 2 | 1.0 | 13.7 | 37.5 |
| | | 6 | | 12.6 | 31.7 |
| | | 10 | | 12.1 | 29.3 |
| | | 14 | | 11.8 | 27.8 |
| | | 18 | | 11.2 | 25.1 |

TABLE 9-continued

| Chemical-thermal treatment | Temperature (° C.) | Time (h) | Boron potential (%) | Pore structure of the material after the chemical-thermal treatments: Average pore size (μm) | Porosity (%) |
|---|---|---|---|---|---|
| | 1050 | 2 | 1.0 | 13.3 | 35.4 |
| | | 6 | | 12.3 | 30.3 |
| | | 10 | | 11.4 | 25.9 |
| | | 14 | | 10.8 | 23.3 |
| | | 18 | | 10.4 | 21.6 |

Embodiment 10

The tenth group of embodiments treated FeAl intermetallic compound porous materials with carburizing processes. Before the carburizing processes, the average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 10.

TABLE 10

| Chemical-thermal treatment | Temperature (° C.) | Time (h) | Carbon potential (%) | Pore structure of the materials after the chemical-thermal treatment: Average pore diameter (μm) | Porosity (%) | Permeated layer thickness (μm) |
|---|---|---|---|---|---|---|
| Carburization | 800 | 1 | 1.0 | 14.6 | 42.6 | 1 |
| | | 3 | | 14.3 | 40.9 | — |
| | | 5 | | 14.1 | 39.8 | — |
| | | 7 | | 13.9 | 38.6 | — |
| | | 9 | | 13.8 | 38.1 | — |
| | 900 | 1 | 1.0 | 13.2 | 34.8 | — |
| | | 3 | | 12.4 | 30.7 | — |
| | | 5 | | 11.7 | 27.4 | — |
| | | 7 | | 10.9 | 23.8 | — |
| | | 9 | | 9.9 | 19.6 | — |
| | 1000 | 1 | 1.0 | 12.6 | 31.7 | — |
| | | 3 | | 11.8 | 27.8 | — |
| | | 5 | | 11.1 | 24.6 | — |
| | | 7 | | 10.3 | 21.2 | — |
| | | 9 | | 9.5 | 18.1 | — |
| | 1100 | 1 | 1.0 | 12.0 | 28.8 | — |
| | | 3 | | 10.3 | 21.2 | — |
| | | 5 | | 9.10 | 16.6 | — |
| | | 7 | | 10.3 | 21.2 | — |
| | | 9 | | 9.5 | 18.1 | — |
| | 1200 | 1 | 1.0 | 10.6 | 22.5 | — |
| | | 3 | | 8.3 | 13.8 | — |
| | | 5 | | 7.1 | 10.1 | — |
| | | 7 | | 5.9 | 6.90 | — |
| | | 9 | | 5.0 | 5.00 | 50 |

Embodiment 11

The seventh group of embodiments treated FeAl intermetallic compound porous materials with nitriding processes. Before the nitriding processes, the average pore size of the materials was 15 μm, and the initial porosity of the materials was 45%. The specific processing parameters, the average pore diameters after the chemical-thermal treatments and the porosities after the chemical-thermal treatments of this group of embodiments are shown in Table 11.

TABLE 11

| Chemical-thermal treatment | Temperature (° C.) | Time (h) | Nitrogen potential (%) | Pore structure of the material after the chemical-thermal: Average pore diameter (μm) | Porosity (%) | Permeated layer thickness (μm) |
|---|---|---|---|---|---|---|
| Nitridation | 550 | 2 | 1.0 | 14.7 | 43.2 | 1 |
| | | 6 | | 14.3 | 40.9 | — |
| | | 10 | | 14.0 | 39.2 | — |
| | | 14 | | 13.8 | 38.1 | — |
| | | 18 | | 13.7 | 37.5 | — |
| | 600 | 2 | 1.0 | 14.1 | 39.8 | — |
| | | 6 | | 13.5 | 36.5 | — |
| | | 10 | | 12.8 | 32.8 | — |
| | | 14 | | 11.9 | 28.3 | — |
| | | 18 | | 11.0 | 24.2 | — |
| | 650 | 2 | 1.0 | 13.7 | 37.5 | — |
| | | 6 | | 12.9 | 33.3 | — |
| | | 10 | | 12.2 | 29.8 | — |
| | | 14 | | 11.4 | 25.9 | — |
| | | 18 | | 10.7 | 22.9 | — |
| | 700 | 2 | 1.0 | 13.1 | 34.3 | — |
| | | 6 | | 11.2 | 25.1 | — |
| | | 10 | | 10.0 | 20.0 | — |
| | | 14 | | 11.4 | 25.9 | — |
| | | 18 | | 10.7 | 22.9 | — |
| | 750 | 2 | 1.0 | 11.9 | 28.3 | — |
| | | 6 | | 9.20 | 16.9 | — |
| | | 10 | | 7.60 | 11.6 | — |
| | | 14 | | 6.40 | 8.20 | — |
| | | 18 | | 5.60 | 6.30 | 25 |

Embodiment 12

The twelfth group of embodiments treated FeAl intermetallic compound porous materials with carbonitriding processes. Before the carbonitriding processes, the average pore diameter of the materials was 15 μm and the initial porosity of the materials was 45%. The specific processing parameters, the average pore diameters after the chemical-thermal treatments and the porosities after the chemical-thermal treatments of this group of embodiments are shown in Table 12.

TABLE 12

| Chemical-thermal treatment | Temperature (° C.) | Time (h) | Carbon potential and nitrogen potential (%) | Pore structure of the material after the chemical-thermal treatment: Average pore diameter (μm) | Porosity (%) | Permeated layer thickness (μm) |
|---|---|---|---|---|---|---|
| Carbonitriding | 700 | 2 | 1.0 | 14.6 | 43.2 | 1 |
| | | 4 | | 14.2 | 40.3 | — |
| | | 6 | | 14.0 | 39.2 | — |
| | | 8 | | 13.8 | 38.1 | — |
| | | 10 | | 13.6 | 36.9 | — |
| | 750 | 2 | 1.0 | 13.6 | 36.9 | — |
| | | 4 | | 12.9 | 33.3 | — |
| | | 6 | | 12.0 | 28.8 | — |
| | | 8 | | 11.2 | 25.1 | — |
| | | 10 | | 10.6 | 22.5 | — |
| | 800 | 2 | 1.0 | 13.1 | 34.3 | — |
| | | 4 | | 12.3 | 33.3 | — |
| | | 6 | | 11.3 | 25.5 | — |
| | | 8 | | 10.8 | 23.3 | — |
| | | 10 | | 10.3 | 21.2 | — |

TABLE 12-continued

| Chemical-thermal treatment | Temperature (° C.) | Time (h) | Carbon potential and nitrogen potential (%) | Pore structure of the material after the chemical-thermal treatment: Average pore diameter (μm) | Porosity (%) | Permeated layer thickness (μm) |
|---|---|---|---|---|---|---|
| | 850 | 2 | 1.0 | 12.4 | 30.8 | — |
| | | 4 | | 10.5 | 22.1 | — |
| | | 6 | | 9.40 | 17.7 | — |
| | | 8 | | 10.8 | 23.3 | — |
| | | 10 | | 10.3 | 21.2 | — |
| | 900 | 2 | | 10.9 | 23.8 | — |
| | | 4 | 1.0 | 8.50 | 14.5 | — |
| | | 6 | | 7.40 | 10.9 | — |
| | | 8 | | 6.10 | 7.40 | — |
| | | 10 | | 5.10 | 5.20 | 35 |

Figure 3:
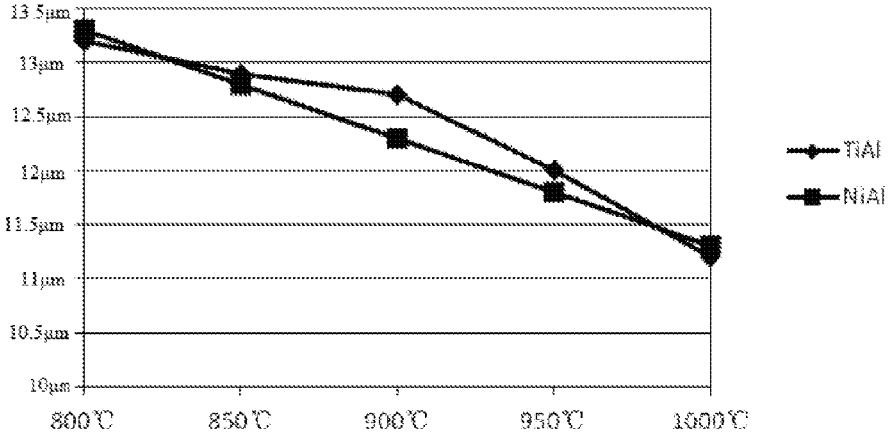
FIG. 3 are the curves of average pore diameter changes for TiAl and NiAl materials carburized separately at different temperatures for 6 hours.
Figure 4:
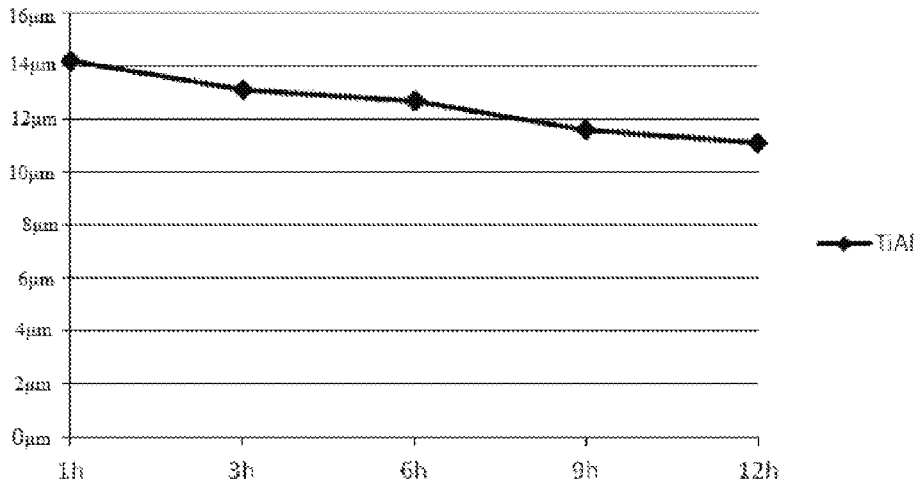
FIG. 4 is the average pore diameter plotted as a function of carburization time at 900° C. for TiAl material
Figure 5:
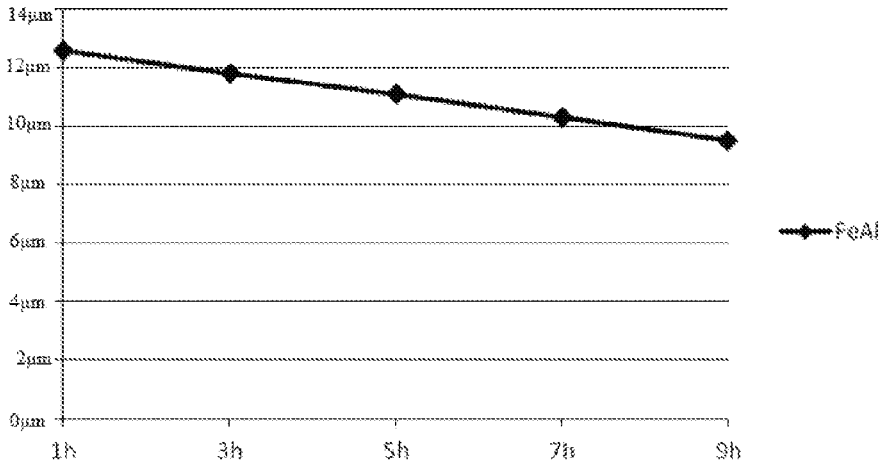
FIG. 5 is the average pore diameter plotted as a function of carburization time at 940° C. for NiAl material FIG. 6 are the corrosion resistance kinetics curves of TiAl material before and after nitriding.

FIGS. 3, 4 and 5 are drawn using some of the data shown in the above 12 examples, to present the effects of temperatures and durations of time of the chemical-thermal treatments on the pore diameters. FIG. 3 shows the average pore diameter changes of TiAl and NiAl materials, respectively, after carburizing for 6 hours at different temperatures. FIG. 4 shows the average pore diameter changes with the carburizing time for TiAl material kept at 900° C. FIG. 5 is the average pore diameter change of FeAl materials kept at 940° C. for different carburizing time. It can be seen from FIGS. 3-5 that the higher the temperatures of the chemical-thermal treatments, the larger the amounts of reductions of the average pore diameters; the longer the durations of the chemical-thermal treatments, the larger the amount of reductions of the average pore diameters. Moreover, the amounts of reductions of average pore diameters of the materials obviously relate with the thickness of the permeated layers, so the thickness of the permeated layers are measured only for the first and the last experiments in each example. From the changes of the thickness of the permeated layers in the first and last experiments of each example, it can be shown that the larger the thickness of the permeated layers, the larger the amounts of reductions of the average pore diameters of the materials.

Then the pore structures of the porous metal materials obtained through the methods described above will be explained in detail combined with FIG. 1 and FIG. 2.

Figure 2:
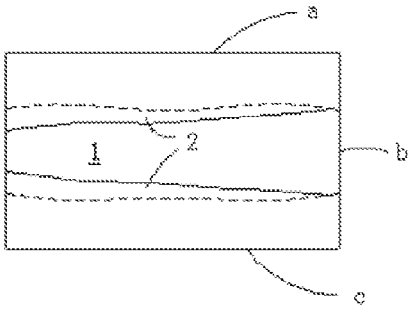
FIG. 2 is a sectional view along A-A in FIG. 1.

As shown in FIG. 1, the pore structures of the porous metal materials include pores 1 distributed on the surfaces of the materials, and permeated layers 2 covered on the surfaces of said pores 1. In FIG. 1 and FIG. 2, the dotted lines represents the pores before chemical-thermal treatments; the solid lines indicate the pores after chemical-thermal treatments; the region between the solid lines and dotted lines indicate the permeated layers 2. Therefore, it can be seen from FIG. 1 and FIG. 2 that the permeated layers 2 covered on the surfaces of the pores 1. During the formations of the permeated layers 2, the original pores of the porous metal materials shrinked due to the lattices distortion and inflation, thus the purpose of adjusting pore diameters is achieved. Therein, the average pore diameter of the pores 1 is best to be 0.05~100 μm. In addition, the porous metal materials are Al-based intermetallic compound porous materials, such as TiAl intermetallic compound porous materials, FeAl intermetallic compound porous materials or NiAl intermetallic compound porous materials. Moreover, the permeated layers 2 can be one kind of carburized layers, nitrided layers, boride layers, sulfide layers, siliconized layers, aluminized layers or chromized layers or co-permeated layers of least two of the elements described above, for instance, carbonitriding layer. On the basis of adjusting the pore diameters, the surface properties of the porous metal materials can be improved as well, such as high temperature oxidation resistance, corrosion resistance and so on.

This invention can apply localized anti-permeation treatments to the porous metal materials during chemical-thermal treatments of the porous metal materials. For example, as shown in FIG. 2, sides a, b and c of the materials can be coated with anti-permeating agents, respectively, so that elements can only enter from the front of pores 1 during chemical-thermal treatments. Thus, the thickness of the permeated layers 2 on the pores 1 exhibit asymmetry from front to back, i.e., the thickness of the permeated layers 2 gradually decrease from front to back along the directions of the pores 1. Thus, the morphology of the porous metal materials is formed similarly to that of an "asymmetric membrane", the pore diameters of pores 1 on one side of the surface of the porous materials are relatively smaller due to the larger thickness of the permeated layers 2, whereas the pore diameters of the pores on the other side of the surface are relatively larger due to the smaller thickness of the permeated layers (or the lack of permeated layers). When the porous materials are used for filtration, the side with relatively smaller pore diameters can be used to realize the separation of the medium to be filtered, so that the permeability of the porous metal materials and the backwash effect can be improved.

The changes of the surface properties of the materials after chemical-thermal treatments are proven below through experiments.

1 The porous TiAl intermetallic compound materials carburized at 900° C. for 6 h were oxidized at 900° C. for 48 h, and then the samples were analyzed by backscattered electron (BSE) photos and spectroscopic analysis. The results show that the surfaces of the pores of the materials before and after the oxidation experiments have similar structures, indicating that the carburized layers still exhibit good thermal stability and oxidation resistance even exposed in high temperature atmosphere.

Figure 6:
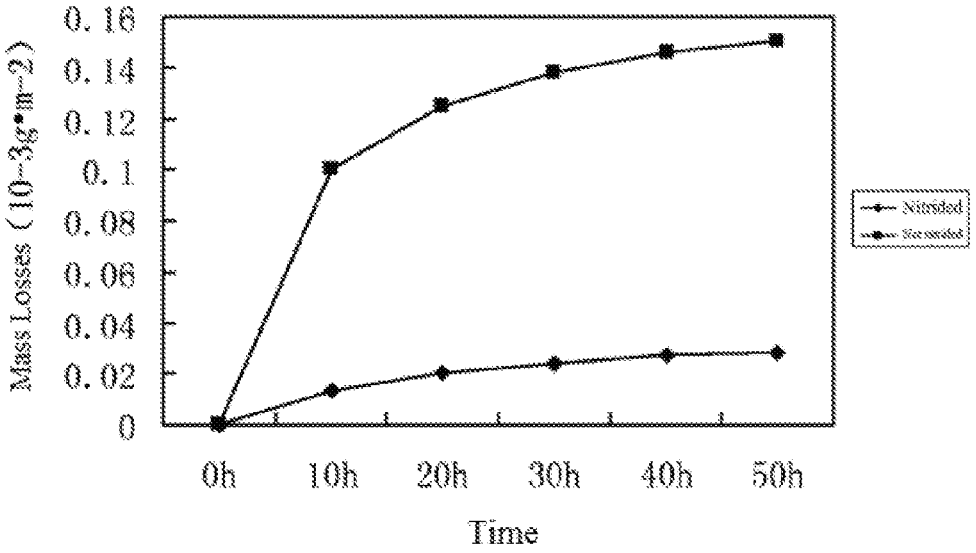

2 Corrosion experiments of TiAl intermetallic compound porous material before and after treated with nitriding at 900° C. for 12 h were conducted separately in pH=3 hydrochloric acid solutions. The results shown in FIG. 6 present the mass losses of the TiAl materials treated with nitriding are clearly lower than the TiAl materials that were not treated with nitriding as the corrosion time.

We claim:

1. A method for treating a surface of a TiAl intermetallic compound porous material to decrease its pore diameters, which comprises:

exposing the TiAI intermetallic compound porous material in an active carburizing atmosphere at a temperature of 800~1200° C. for 1~12 hours while maintaining carbon potential at 0.8~1.0%.

2. A method for treating a surface of NiAl intermetallic compound porous material to decrease its pore diameters, which comprises:

exposing the NiAl intermetallic compound porous material in an active carburizing atmosphere at a temperature of 800~1200° C. for 2~10 hours while maintaining carbon potential at 1.0~1.2%.

3. A method for treating a surface of FeAl intermetallic compound porous material to decrease its pore diameters, which comprises:

exposing the FeAl intermetallic compound porous material in an active carburizing atmosphere at a temperature of 800~1200°C. for 1~9 hours while maintaining carbon potential at 0.8~1.2%.

* * * * *